US005494466A

United States Patent [19]

Vernea

[11] Patent Number: 5,494,466

[45] Date of Patent: Feb. 27, 1996

[54] TRANSMISSION FOR DUAL PROPELLERS DRIVEN BY AN INBOARD MARINE ENGINE

[76] Inventor: Stefan Vernea, 295 Sesame St., Middleburg, Fla. 32065

[21] Appl. No.: 381,351

[22] Filed: Jan. 31, 1995

[51] Int. Cl.[6] ..... B63H 23/02

[52] U.S. Cl. ..... 440/75; 74/377; 74/417; 192/51; 416/129; 440/80

[58] Field of Search ..... 440/75, 80, 81; 416/128, 129 R, 129 A; 74/377, 417; 192/51

[56] References Cited

U.S. PATENT DOCUMENTS

| | | | |
|---|---|---|---|
| 773,006 | 10/1904 | Dyott | 416/129 A |
| 3,350,958 | 11/1967 | Casale | 74/417 |
| 3,478,620 | 11/1969 | Shimanckas | 440/75 |
| 3,505,894 | 4/1970 | Halibrand | 440/75 |
| 3,520,205 | 7/1970 | Halibrand | 440/75 |

FOREIGN PATENT DOCUMENTS

| | | | |
|---|---|---|---|
| 293294 | 11/1989 | Japan | 440/80 |
| 363939 | 12/1931 | United Kingdom | 440/80 |
| 1310472 | 3/1973 | United Kingdom | 416/129 A |

*Primary Examiner*—Sherman Basinger
*Attorney, Agent, or Firm*—Arthur G. Yeager

[57] ABSTRACT

Transmission for a single engine drive for dual concentric propellers in a straight or V-drive arrangement with the straight-drive including four shafts and nine gears and the V-drive adding two more shafts and four more gears.

6 Claims, 5 Drawing Sheets

TRANSMISSION FOR DUAL PROPELLERS DRIVEN BY AN INBOARD MARINE ENGINE

FIELD OF THE INVENTION

This invention relates to a gear transmission for an inboard marine engine.

BACKGROUND OF THE INVENTION

There are three general types of engine drives for recreational boats namely, inboard, outboard, and inboard-outboard. "Inboard" means that the engine and its driving shaft and Other components are positioned entirely inside the boat. "Outboard" means that the engine and its driving components are mounted on the transom and hang outside the boat. "Inboard-outboard" means a combination of the other two, wherein the engine is inside the boat and the drive shaft and some other drive components overhang the transom as in the outboard type. Generally, the outboard design takes up less space inside the boat, and the propellers can be lifted out of the water to permit the boat to be kept in shallow waters. The inboard design generally is forward on larger sizes of boats that need not be used in shallow waters. The inboard-outboard attempts to employ the best of both other types, in that the engine is inboard but the propellers can be lifted so as to be navigable in shallow waters. Inboard-outboard designs have employed dual propeller systems.

There has been prior knowledge of dual propellers employed on large ocean-going vessels, but there has not been known any use of dual, counter-rotating closely spaced concentric propellers on small recreational boats, i.e., boats of about 20–80 feet in length. The principal designs of such small boats have been for outboard or inboard-outboard engines in order for the boat to navigate shallow waters. Designs of inboard engines have avoided the dual concentric propeller feature for a variety of reasons, although many such boats employ two engines, each driving a single separate propeller, thus being defined as dual propellers, although not concentric.

It is an object of this invention to provide a transmission to connect a single engine on a small recreational boat to two concentric counter-rotating propellers. It is another object of this invention to provide a transmission to drive two concentric counter-rotating propellers through a V-drive system wherein the output drive shaft of the engine and the drive shafts of the propellers are at an acute angle to each other. Still other objects will appear in the more detailed description which follows.

BRIEF SUMMARY OF THE INVENTION

This invention relates to a transmission for an inboard marine engine driving dual, counter-rotating, closely spaced, concentric propellers in a small recreational boat, comprising an inner drive shaft rotating concentrically inside an outer hollow drive shaft, said drive shafts connected respectively to an inner propeller and an outer propeller, and connected to each other through a plurality of gears, said drive shafts having respectively proximal forward ends adjacent said engine and distal aft ends adjacent said propellers; said engine driving said inner shaft on which are mounted an assembly or a forward drive gear, a clutch, and a rearward drive gear with said clutch adapted to selectively release either of said drive gears from engagement with said inner drive shaft while operatively engaging the other of said drive gears to said inner drive shaft; said plurality of gears being mounted on said inner-drive shaft; a first auxiliary shaft, or a second auxiliary shaft; said inner-drive shaft having rigidly mounted thereon a forward inner drive shaft gear adjacent said assembly and a forward outer drive shaft gear aft of said inner drive shaft gear and freely rotatable about said inner drive shaft said first auxiliary shaft having rigidly mounted thereon a forward first gear meshed with one of the drive gears of said assembly, a middle second gear, and an aft third gear meshed with said outer shaft.

In a specific and preferred embodiment of this invention a V-drive system is provided by the addition of a branch inner drive shaft and a branch outer drive shaft set at an angle to the inner and outer drive shafts mentioned above and leading to the propellers outside the boat and below the water level. These branch drive shafts are combined with four more gears to transmit the rotational forces from the engine to the propellers.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The invention is best understood by reference to the attached drawings.

Figure 1:
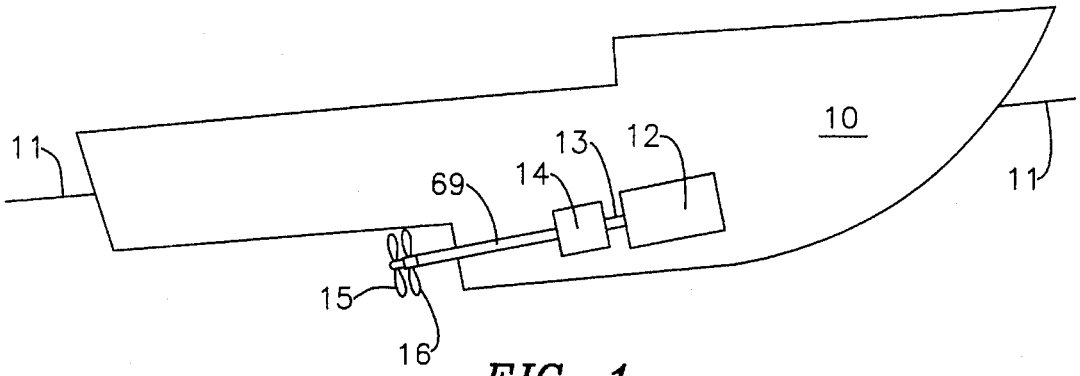
FIG. 1 is a schematic side elevational view of a boat with an inboard engine and a straight-drive transmission driving dual propellers according to this invention.
Figure 2:
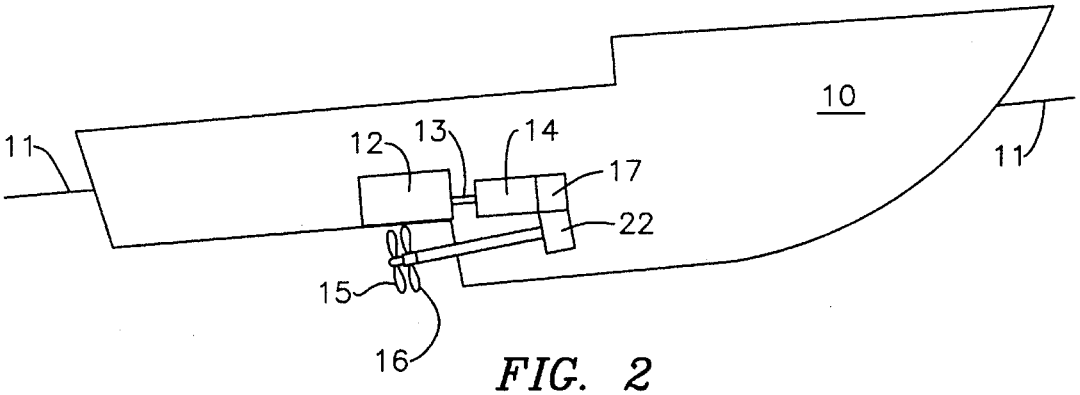
FIG. 2 is a schematic side elevational view of a boat with an inboard engine and a V-drive transmission driving dual propellers according to this invention.

In FIGS. 1 and 2 there are shown two arrangements for employing an inboard engine to drive a small recreational speed boat 10 (approx. 20–80 ft. long). In FIG. 1 there is shown the "straight" or "in-line" drive where the engine 12, its drive shaft 13, the transmission 14, and the propellers 15 and 16 and their drive shafts 69 are in a single straight line from engine 12 to propellers 15, 16 beneath water line 11. In FIG. 2 there is shown a V-drive where the straight line of drive shafts in FIG. 1 is broken into two parts with a connecting knee joint at 22. In this configuration engine 12 faces in an opposite direction from that of FIG. 1 with its drive shaft 13, and transmission 14 leading to V-drive transmission 17 where the propeller drive shaft 69 reverses in direction and angles downward to pass through the hull of the boat 10 to propellers 15 and 16 beneath water line 11. It should be noted the positioning and orientation of propellers 15 and 16 is the same in both of FIGS. 1 and 2. The only difference is the inclusion or exclusion of the V-drive transmission 17. Generally, the V-drive arrangement is employed when there is insufficient room to use the straight "in-line" drive.

Figure 3:
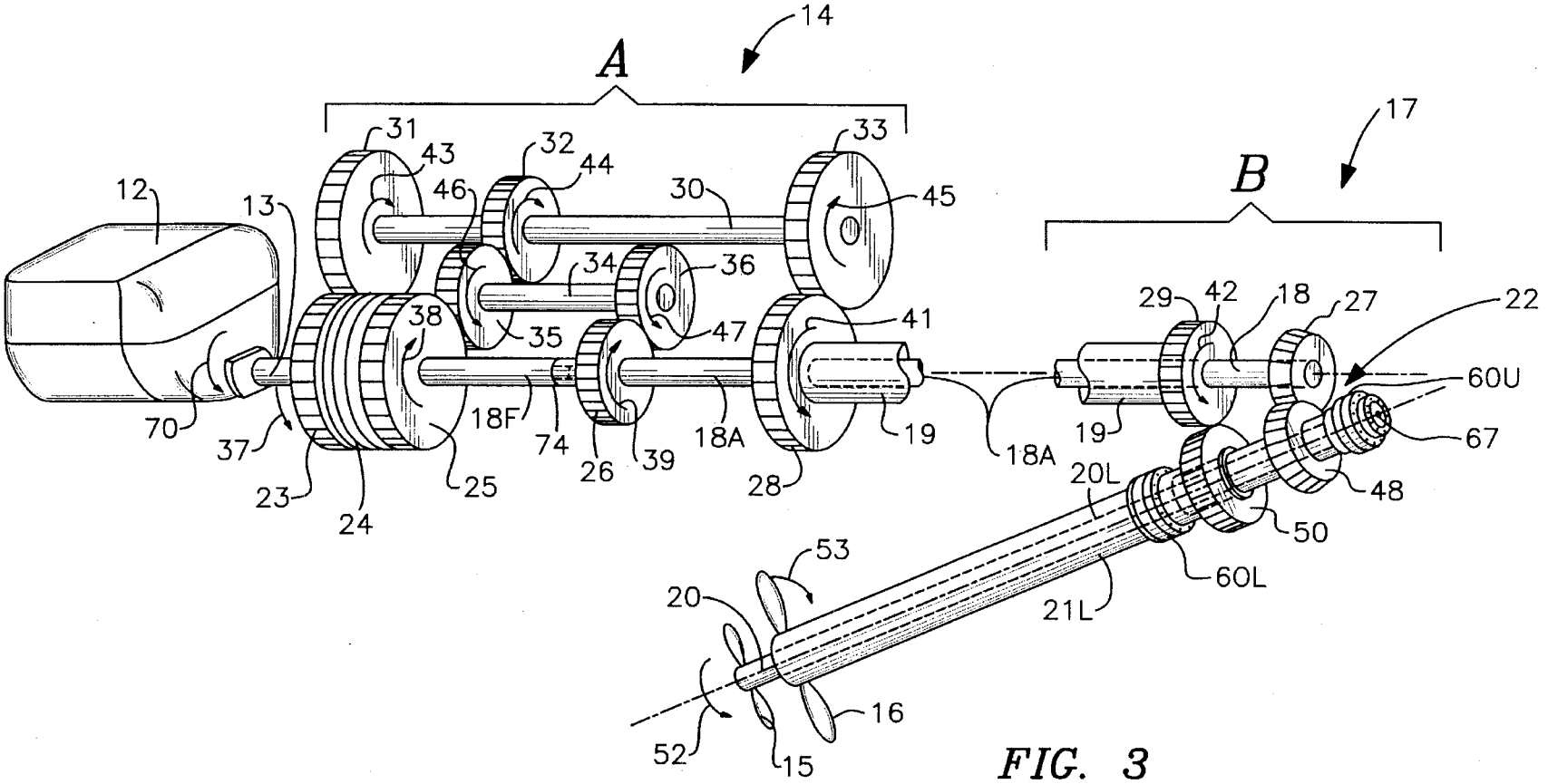
FIG. 3 is a schematic perspective view of the shafts and gears of the transmission of this invention.

In FIG. 3 there is a schematic view of the gears and shafts in the main transmission 14 and V-drive transmission 17 showing how the driving forces of the engine 12 are transmitted to the propellers 15 and 16. The engine drive shaft 13 is extended by shaft 18F which passes into clutch 24 having a forward driving gear 23 rotatable around shaft 18F at the forward end and a rearward driving gear 25 rotatable around shaft 18A at the aft end. The clutch is operated by a lever means (55 in FIG. 4) controlled by the operator of the boat to move the boat forward or rearward (reverse) in the water. The clutch may be of any type or configuration that is capable of engaging the selected drive gear 23 or 25 to the drive shaft extension 18F and disengaging the other of the gears 23 and 25 and allowing it to rotate freely around shaft 18F. Drive shaft 18F is connected to shaft 18A at junction 74 as will be described below shaft 18A becomes the inner drive shaft which drives the inner propeller 15 and an outer drive shaft 19 starts at gear 28 and continues on to outer propeller 16. From gear 28 to propellers 15 and 16 there are two concentric shafts rotating in opposite directions with respect to each other. Inner drive shaft 18 has rigidly mounted on it a forward inner drive gear 26 and an aft or rearward inner drive gear 27. Outer drive shaft 19 has a forward outer drive gear 28 and an aft or rearward outer drive gear 29. Outer drive shaft 19 and gears 28 and 29 which are rigidly attached to outer drive shaft 19 are journaled with suitable bearings to rotate around inner drive shaft 18. If the complete system is a straight in-line drive, as in FIG. 1, there is no need for gears 27 and 29 and the drive shafts 18A and 19 may extend directly to propellers 15 and 16 with whatever bearings and seals are needed in passing through the hull to the water. If a V-drive, as in FIG. 2, is to be employed a branch drive system consisting of gears 27, 29, 48 and 50 and branch drive shafts 20 and 21 are needed. Rearward inner shaft gear 27 meshes with branch inner shaft gear 48 to drive inner propeller 15; while rearward outer drive shaft gear 29 meshes with branch outer drive shaft gear 50 to drive outer propeller 16.

In order to transmit the forces from engine drive shaft 13 to two concentric, counter-rotating drive shafts 18, 19 and 20, 21 there are employed two auxiliary shafts and five more gears. The first auxiliary drive shaft 30 has three gears 31, 32, 33 rigidly attached thereto. The second auxiliary drive shaft 34 has two gears 35 and 36 rigidly attached thereto. Forward gear 31 of first auxiliary drive shaft 30 is meshed with forward driving gear 23. Middle gear 32 of first auxiliary drive shaft 30 is meshed with forward gear 35 of second auxiliary drive shaft 34, which also is meshed with rearward driving gear 25 on drive shaft 18. Rearward gear 36 of second auxiliary drive shaft 34 is meshed with forward inner drive gear 26. Rearward gear 33 of first auxiliary drive shaft is meshed to forward outer drive gear 28.

The gears in FIG. 3 are shown with directional arrows to represent how the gears and propellers turn when clutch 24 is shifted to the forward direction. When so shifted, the direction 70 of engine shaft 13 is engaged to forward driving gear 23 to turn it in the direction 37 (same as direction 70) and gear rearwardly driving gear 25 is disconnected from drive shaft 18F to function merely as an idler gear turning as forced to by gear 35, but not transmitting any force to drive shaft 18F. Forwardly driving gear 23 causes gear 31 to rotate in the direction 43, which causes both of gears 32 and 33 to turn in the same direction; namely, 44 and 45. Gear 35 is turned in the direction 46 by meshing with gear 32 turning in direction 44. Rearward driving gear turns freely, unconnected to drive shaft 18F, in the direction 38 by reason of being meshed with gear 35. Rear gear 33 on first auxiliary drive shaft 30 turns in the direction 45 and causes forward outer drive gear 28 to turn in the direction 41, which is opposite to the direction 39 of gear 26 and of shaft 18F. These two opposite directions are transmitted through gears 27, 29, 48 and 50 to cause propellers 15 and 16 to turn in directions 52 and 53 respectively, which are counter-rotational. There is a coupling 74 wherein shafts 18F and 18A are joined together with an inner torque of shaft 18F journaled in a recess in shaft 18A. These portions are joined with a bearing 58 such that shaft 18F rotates freely with respect to shaft 18A. The driving force of engine 12 passes from gears 23 or 25 through auxiliary shafts 30 or 34 to shaft 18A through gears 26 and 28 which are rigidly attached to shafts 18A and 19, respectively.

If the pilot wishes to drive the boat in reverse, he shifts the clutch lever 55 to reverse causing reverse driving gear 25 to turn in the direction 70 of the engine, i.e., opposite to direction 38 while leaving gear 23 disconnected from shaft 18F and free to turn as gear 31 causes gear 23 to turn. The driving gear is 25 turning oppositely to direction 38, which in turn causes gear 35 and gear 32 to turn oppositely to directions 46 and 44, respectively. Gear 26 will turn oppositely to direction 39 because reverse driving gear 25 is turning oppositely to direction 38. Since gear 32 is turning oppositely to direction 44, so likewise will gears 31 and 33 turn oppositely to directions 43 and 45 and this causes gear 28 to turn opposite to direction 41. Thus with reverse gear 25 transmitting the driving forces in the direction 70 of engine shaft 13, inner drive shaft 18A and outer drive shaft 19 will turn oppositely to directions 39 and 41 causing propellers 15 and 16 to turn oppositely to directions 52 and 53.

FIG. 3 indicates two main components of the transmission for ready identification: A is the main transmission including all gears and shafts needed for a straight on-line system as in FIG. 1. V-drive bolts direct to the transmission. B represents what is referred to as a "branch drive" needed to continue the drive shaft to the propellers from the knee joint 22 in the new direction to constitute a V-drive.

Figure 4:
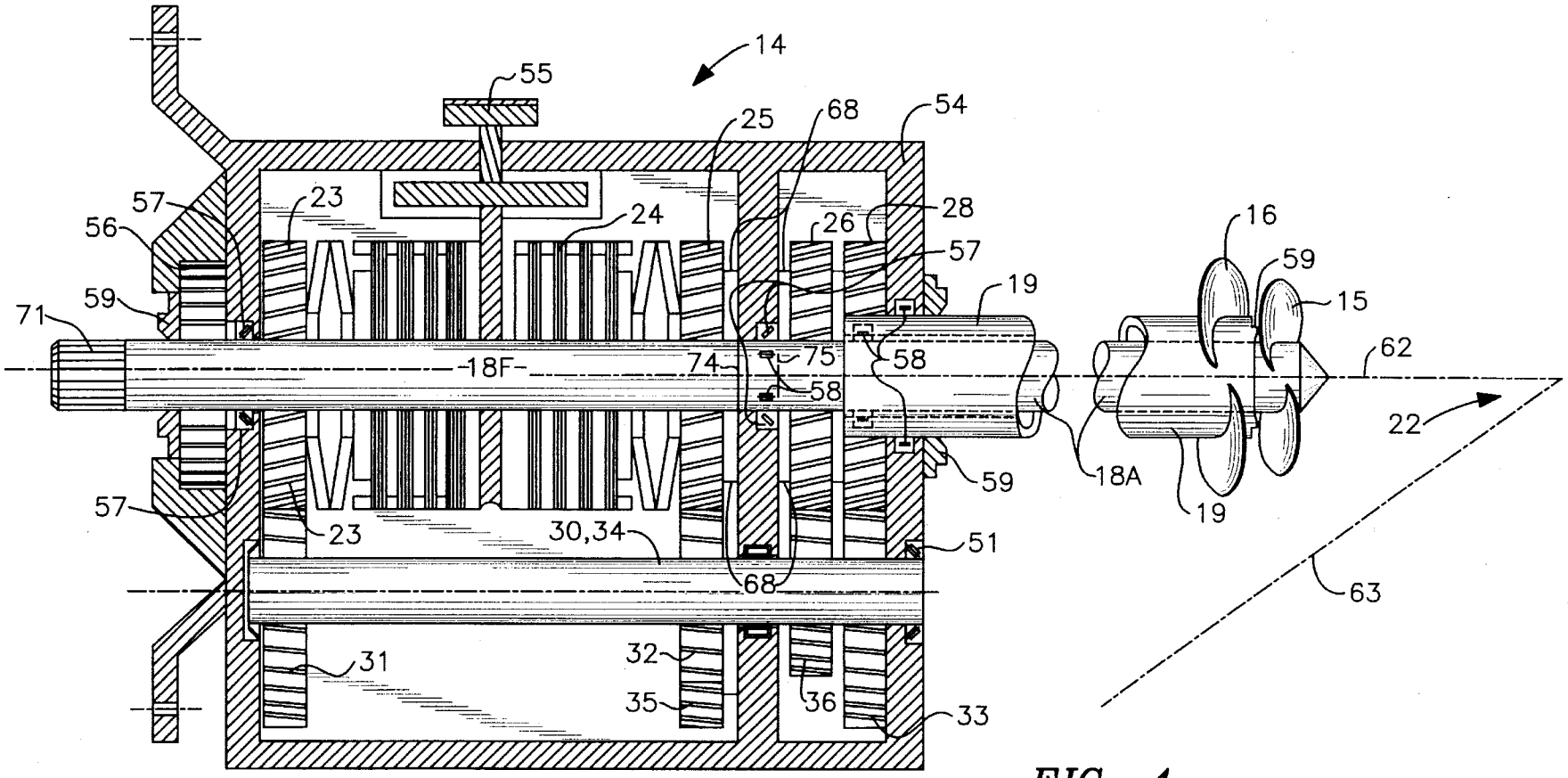
FIG. 4 is a schematic side elevational cutaway view of the main transmission of this invention for a straight drive.

FIG. 4 is a schematic horizontal cutaway of main transmission (A in FIG.3) showing how shafts 18F, 18A and 19 and gears 23, 24, 26, 28, 31, 32, 33, 35 and 36 are positioned together to make a transmission in a compressed space. A housing 54 is made to journal shafts 18F, 18A, 19, 30 and 34 in suitable bearings, such as thrust bearings 57 and roller bearings or ball bearings 58. Shafts 30 and 34 have been rotated from their actual positions (see FIG. 6) in order to simplify the drawing and it should be realized that any arrangement may be employed, so long as the gear mounting and engagement with other gears as shown in FIG. 3 is followed. Clutch lever 55 is shown, and would be connected to other control levers, cables, or the like to permit the final control lever to be in the cockpit of the boat within the pilot's reach for convenience. Main drive 18F is shown with a splined end 71 for coupling to the engine shaft 13 (See FIG. 3). There is shown in FIG. 4 a gear 56, not shown in FIG. 3. This is a gear for the oil pump, which conveniently is mounted on the transmission housing so as to provide pressure for shifting and operating clutch 24 and may be of assistance in providing lubrication to the transmission. Oil seals 59 are employed to contain the oil inside housing 54. All other gears as shown in FIG. 3 are shown here in FIG. 4 which relate to the main transmission (A in FIG. 3). The counter-rotating shafts 18A and 19 are shown here to terminate at propellers 15 and 16, although it will be seen in FIG. 5 how a connection may be made for a V-drive.

Figure 5:
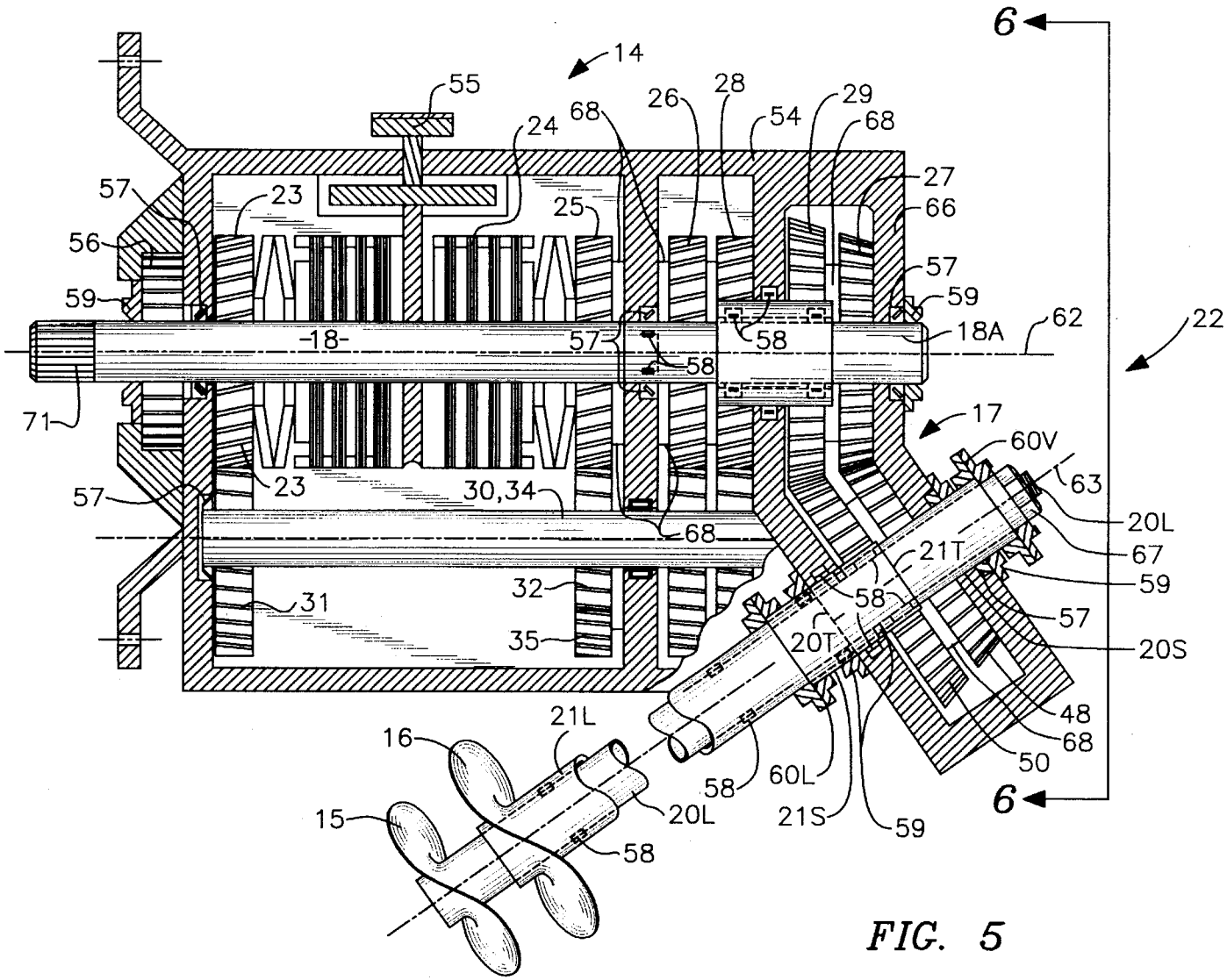
FIG. 5 is a schematic side elevational cutaway view of the transmission of this invention for a V-drive.

FIG. 5 shows V-drive transmission 17 (B in FIG. 3) added to the main transmission (A in FIG. 3) to provide a V-drive arrangement.

V-drive transmission 17 includes a housing extension 66 for four gears, two of which 27 and 48 are meshed to drive branch inner drive shaft 20, and the other two of which 29 and 50 drive branch outer drive shaft 21. Aft inner drive shaft gear 27 is rigidly mounted on main inner drive shaft 18A and meshed with branch inner drive shaft gear 48 to branch inner drive shaft 20. Aft outer drive shaft gear 29 is rigidly mounted on main outer drive shaft 19 and meshed with branch outer drive shaft gear 50 to branch outer drive shaft 21. It should be noted that gears 27, 29, 48 and 50 must be bevelled gears because of the angle between axis 62 and axis 63. Suitable bearings 57 and 58 and oil seals 59 are employed where necessary. The transmission of this invention may include only the main transmission 14, or both the main transmission 14 and the V-drive transmission 17 depending on how the owner of the boat 10 decides to mount his engine 12, ie. straight-drive or V-drive.

Branch inner drive shaft 20 and branch outer drive shaft 21 are preferably each broken into two portions for ease of maintenance. Each of shafts 20 and 21 has a lower elongated portion labeled by the initial L, thus showing as 20L and 21L; and all upper short stub portion labeled by the initial S, thus 20S and 21S. The branch inner drive shaft 20 has portions 20S and 20L rigidly bolted together at coupling 60U (the upper coupling). FIG. 5 shows both portions of shaft 20 to be hollow and concentrically spaced apart from each other with 20L the elongated portion extending from coupling 60U to inner propeller 15 and with 20S the short stub portion outside of 20L and extending from coupling 60U to 20T. Outer branch drive shaft has a lower elongated portion 21L extending from outer propeller 16 to coupling 60L, and with 20L spaced away from and concentrically inside of 21L. Portion 21S is a short stub length extending from coupling 60L to upper terminus 21T, and being spaced away from and concentrically outside of 20S. Gear 48 is rigidly attached to the outside of inner stub shaft 20S and gear 50 is rigidly attached to the outside of outer stub shaft 21S. Coupling 60L bolts outer shafts 21S and 21L together in an abutted relationship. Suitable bearings 58 are placed between concentric branch shafts 20L and S, and 21L and S and oil seals are also suitably employed to prevent inner lubricating oil from mixing with outer water. Nut 67 is employed on the threaded upper end of shaft 20L to attach the upper half of coupling 60U to shaft 20 while the lower half of coupling 60U is rigidly attached to stub shaft 20S.

Figure 6:
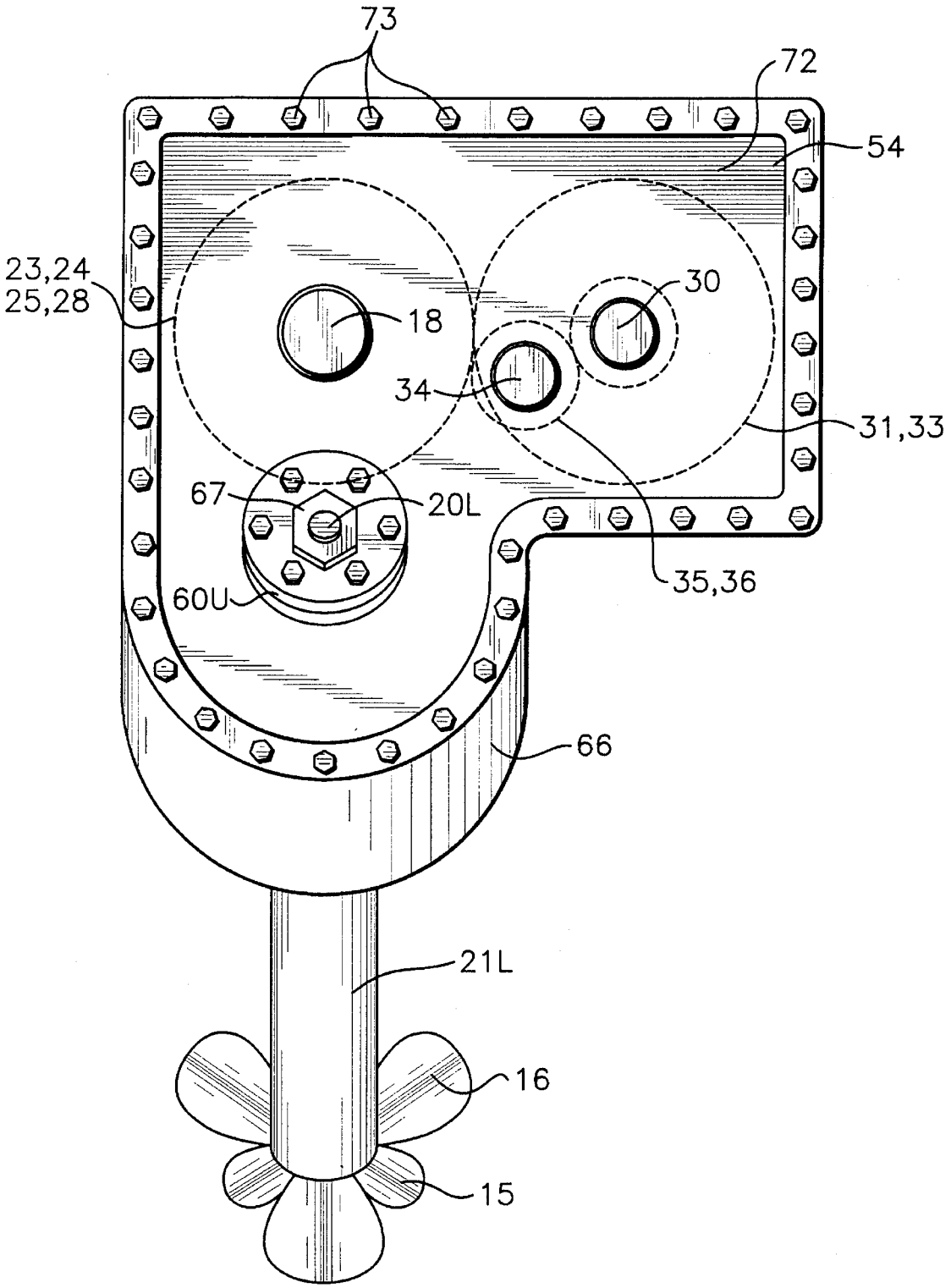
FIG. 6 is an end view elevation taken in the direction shown in FIG. 5.

FIG. 6 shows an end elevational view of the transmission of FIG. 5, i.e. a view taken in the direction shown by the labeled arrow in FIG. 5. This drawing shows the spatial arrangement of shafts 18, 20L, 21L, 30, and 34. As mentioned above in FIGS. 4 and 5, shafts 30 and 34 have been rotated out of their actual positions so as to view gears 31, 32, 33, 35, and 36; and to understand how shafts 20L and 21L are positioned without interference with the lower right-hand portion of transmission 14 and housing 54 (shown broken away in FIG. 5).

An advantage of dual propellers is efficiency because there is a water slippage around a propeller such that a pitch of 15 inches may not actually translate into 15 inches of movement through the water per revolution of the propeller. Dual propellers mounted closely adjacent each other, e.g., spaced apart not more than about one diameter of the propeller, tend to have less total slippage in the water than one propeller. Furthermore, dual propellers provide more lift to the stern than does a single porpeller, and this translates into less time to reach planing speed, and/or lower planing speeds. Dual propellers also generally provide about a 25% increase in boat speed at cruising engine speeds of about 3000–3500 r.p.m. This translates into greater range for a tank of fuel and/or greater fuel economy.

A comparison between single and dual propeller boats driven by comparable engines is shown in the tabulation below based on published data. The single propeller boat was 20 feet long by 7 feet 4 inches wide and powered by a 265 HP engine with a single propeller having a 13-inch pitch. The dual propeller data came from twelve boats ranging from 19.3–24.8 feet long and 8.0–8.5 wide, with engines of 230–245 HP and with dual propellers having a pitch of 19–23 inches.

TABLE I

| | mph at 3000–3500 rpm | mph at 4600–4800 | Planing Time Sec. |
|---|---|---|---|
| Single Propeller | 33 | 43 | 10–15 |
| Dual Propeller | 35 | 47 | 3.4–7.0 |

These data show the general advantage of dual propellers to be greater speed and quicker planing time. Generally, a larger diameter single propeller provides higher speed but slower planing time, and conversely, a smaller diameter propeller provides quicker planing time but slower speed.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A transmission for an inboard marine engine driving dual, counter-rotating, closely spaced concentric propellers in a small recreational boat, comprising an inner drive shaft rotating concentrically inside an outer hollow drive shaft, said drive shafts connected respectively to an inner propeller and an outer propeller, and connected to each other through a plurality of gears, said drive shafts having respectively proximal forward ends adjacent said engine and distal aft ends adjacent said propellers; said engine driving said inner shaft on which are mounted an assembly of a forward drive gear, a clutch, and a rearward drive gear with said clutch adapted to selectively release either of said drive gears from engagement with said inner drive shaft while operatively engaging the other of said drive gears to said inner drive shaft; said plurality of gears being mounted on said inner drive shaft, a first auxiliary shaft, and a second auxiliary shaft; said inner drive shaft having rigidly mounted thereon a forward inner dirve shaft gear adjacent said assembly and a forward outer drive shaft gear aft of said inner drive shaft gear; and freely rotatable about said inner drive shaft, said first auxiliary shaft having rigidly mounted thereon a forward first gear meshed with one of the drive gears of said assembly, a middle second gear, and an aft third gear meshed with said outer shaft drive gear; said second auxiliary shaft having rigidly mounted thereon a forward first gear meshed with the other of the dirve gears of said assembly and also meshed with said middle second gear, and an aft second gear meshed with said inner shaft dirve gear; and connecting means coupling said inner shaft drive gear to said inner propeller and coupling said outer shaft drive gear to said outer propeller.

2. The transmission of claim 1 wherein said assembly comprises said forward drive gear mounted on said inner drive shaft adjacent said marine engine, said clutch mounted on said inner drive shaft adjacently aft of said forward drive gear, and said rearward drive gear mounted on said inner drive shaft immediately aft of said clutch.

3. The transmission of claim 2 wherein said forward first gear of said first auxiliary shaft is meshed with said forward drive gear, and said forward first gear of said second auxiliary shaft is meshed with said rearward drive gear.

4. The transmission of claim 1, which additionally includes an aft inner drive shaft gear rigidly mounted on said inner drive shaft and spaced rearwardly from said forward inner drive shaft gear and an aft outer drive shaft gear rigidly mounted on said outer drive shaft and spaced rearwardly from said forward outer drive shaft gear, said inner drive shaft terminating at said aft inner drive shaft gear and said outer drive shaft terminating at said aft outer drive shaft gear; and a V-drive combination comprising an inner drive shaft leg concentrically rotatable inside an outer drive shaft leg wherein the long axis of said inner and outer drive shafts is set at an acute angle to the long axis of said inner and outer drive shaft legs with said propellers mounted at the lower ends of said inner shaft leg and said outer shaft leg respectively; said inner drive shaft leg having rigidly mounted thereon an inner drive shaft leg gear meshed with said aft inner shaft drive gear, and said outer drive shaft leg having rigidly mounted thereon an outer drive shaft leg gear meshed with said outer drive shaft gear.

5. A V-drive transmission connected to an inboard marine engine for driving dual counter-rotating closely spaced concentric propellers on a small recreational boat comprising an inner drive shaft rotating concentrically inside an outer hollow drive shaft, said drive shafts rotating in opposite directions with respect to each other; an inner propeller rigidly mounted on said inner drive shaft and an outer propeller rigidly mounted on said outer drive shaft, said drive shafts extending from said engine to said propellers along two intersecting straight-line legs, forming a V-shape, one said leg being a main drive shaft, which is substantially horizontal and the other said leg being a branch drive shaft, which is directed downwardly at an acute angle to terminate at said propellers underwater outside the hull of the boat; said transmission comprising a first combination of a main inner drive shaft rotatable inside a main outer drive shaft, said first combination extending from a forward position adjacent said engine to a rearward knee joint, a second combination of a branch inner drive shaft rotatable inside a branch outer dirve shaft, said second combination extending from said knee joint to said propellers, and a plurality of gears, each attached to one of the said shafts of said first and second combinations; said first combination including said main inner drive shaft, said main outer drive shaft, a first auxiliary shaft and a second auxiliary shaft and eleven gears mounted on one of said shafts of said first combination, said main inner drive shaft having mounted thereon in the order listed from adjacent said engine to adjacent said knee joint, a forward driving gear, a clutch, a rearward driving gear, a forward inner drive gear, and an aft inner drive gear, said first auxiliary shaft having rigidly mounted thereon three spaced gears in the order listed below from adjacent said engine to adjacent said knee joint, a forward first gear meshed with said forward driving gear, a middle second gear, and an aft third gear; said second auxiliary shaft having rigidly mounted thereon two spaced gears in the order listed below from adjacent said engine to adjacent said knee joint, a forward first gear meshed with both said rearward driving gear and said middle second gear, and an aft second gear meshed with said forward inner drive gear; said main outer drive shaft having rigidly mounted thereon a forward first gear meshed with said aft third gear on said first auxiliary shaft and an aft second gear at the aft end of said main outer drive shaft at said knee joint; said second combination including said branch inner drive shaft with an aft gear rigidly mounted thereon at said knee joint and meshed with said aft second gear of said main inner drive shaft, and an outer drive gear rigidly mounted on said branch outer drive adjacent said knee and meshed with said aft second gear and said main outer drive shaft; said inner and outer propellers being rigidly mounted on the underwater ends respectively of said branch inner drive shaft and said branch outer drive shaft.

6. The V-drive transmission of claim 5 wherein said branch inner drive shaft includes a lower inner propeller drive shaft extending from said inner propeller to said knee joint and a hollow stub inner drive shaft concentrically spaced outside of, and coupled to said lower inner propeller drive shaft, and extending from said knee joint to adjacently below said aft gear, with said aft gear being rigidly attached to said stub inner drive shaft; and wherein said branch outer drive shaft includes a lower outer propeller drive shaft extending from said outer propeller to a coupling adjacently below said outer drive gear, and a stub outer drive shaft exetnding from said coupling to adjacent said aft gear, said stub outer drive shaft being spaced concentrically outside of said stub inner drive shaft, rigidly attached to said outer drive gear, and being coupled as an extended abutment to said lower outer propeller drive shaft.

* * * * *